US006344112B1

(12) United States Patent
Hernesniemi

(10) Patent No.: US 6,344,112 B1
(45) **Date of Patent: *Feb. 5, 2002**

(54) SCREEN HAVING INCLINED SLOTS FOR A DIGESTER

(75) Inventor: Lasse Hernesniemi, Pietarsaari (FI)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/421,671

(22) Filed: Oct. 20, 1999

Related U.S. Application Data

(63) Continuation of application No. 08/894,528, filed as application No. PCT/FI96/00104 on Feb. 22, 1996, now Pat. No. 6,039,841.

(30) Foreign Application Priority Data

Feb. 23, 1995 (FI) ..... 950826

(51) Int. Cl.[7] ..... D21C 7/00; B07B 1/49; B01D 29/07

(52) U.S. Cl. ..... 162/251; 162/237; 162/17; 162/19; 162/39; 209/397; 210/485; 210/498; 210/499

(58) Field of Search ..... 162/237, 251, 162/17, 19, 37, 39, 40, 248, 249, 243, 374; 209/273, 305, 306, 406, 407, 395, 393, 410, 411, 281, 283, 397; 210/499, 498, 485

(56) References Cited

U.S. PATENT DOCUMENTS

| | | | |
|---|---|---|---|
| 2,712,776 | A | 7/1955 | Wagenknecht |
| 3,713,541 | A | 1/1973 | Nelson |
| 4,795,560 | A | 1/1989 | Chupka et al. |
| 4,909,906 | A | 3/1990 | Bartelmuss et al. |
| 5,234,550 | A | 8/1993 | Ekholm et al. |

FOREIGN PATENT DOCUMENTS

| | | |
|---|---|---|
| WO | WO 95/16817 | 6/1995 |

*Primary Examiner*—Stanley S. Silverman
*Assistant Examiner*—Dionne A. Walls
(74) *Attorney, Agent, or Firm*—Nixon & Vanderhye P.C.

(57) ABSTRACT

A screen used in the production of cellulose pulp may be mounted in a digester to minimize traditional screen problems (including clogging) without introducing new problems. The screen comprises a screen plate having a plurality of slots formed in it with an inclination angle, which is 30–60° with respect to the bottom edge of the screen plate. The screen plate may comprise a plurality of parallel screen bars side-by-side, or an integral metal plate with slots formed in it. The slots have a width between 1–5 (e.g. 2–4) millimeters and a spacing between them of 3–9 millimeters.

15 Claims, 2 Drawing Sheets

SCREEN HAVING INCLINED SLOTS FOR A DIGESTER

Figure 1:
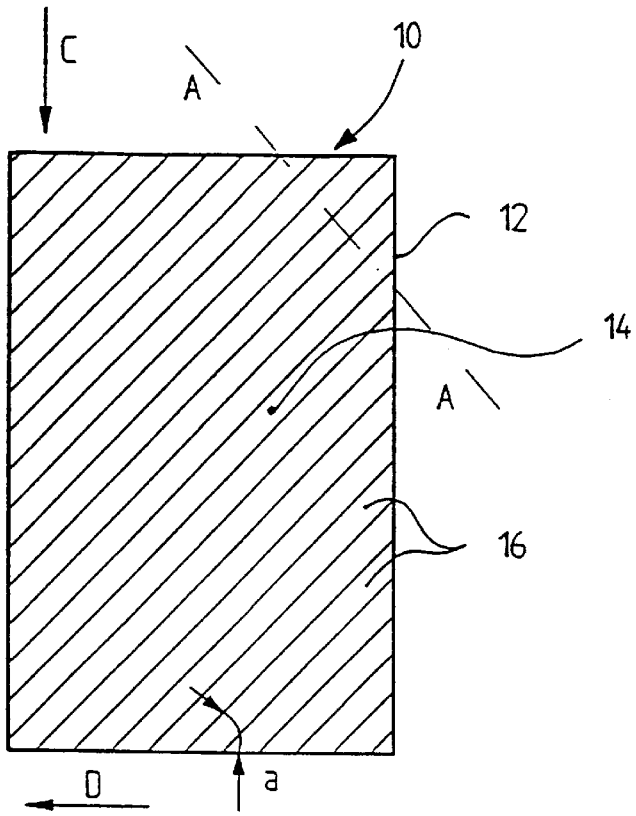

This is a continuation of application Ser. No. 08/894,528, filed Dec. 2, 1997, now U.S. Pat. No. 6,039,841, which is a 371 of PCT/FI96/00104, filed Feb. 22, 1996, the entire content of which is hereby incorporated by reference in this application.

The present invention relates to a screen primarily intended for passing liquor through a layer of pulp. The invention is advantageously employed in removing cooking liquor when producing chemical cellulose pulp or paper pulp in a continuous digester.

Environmental loading caused by industry is regarded as one of the most serious problems in today's society. In chemical pulp production, great importance has been attached to improving production methods so that environmentally harmful effluents and emissions will be minimized. Special progress has been made in improvements related to bleaching of chemical pulp. New environmentally friendly bleaching methods impose greater requirements than previously on the strength of every fiber being fed into the bleaching. Thus, the digester has to be constructed such that the cooking process will be as gentle for fibers as possible. One way to achieve a gentle cook is to keep the temperature and alkalinity profiles as uniform as possible throughout the whole cross-sectional area of the digester. Achieving a sufficiently uniform cross-section profile imposes great requirements on the screen arrangement, the task of which is to enable an efficient throughput of liquid through a pulp layer.

Recently, it has been noted more and more often that large flows of circulation liquid passing through the screens are needed to achieve the desired-uniformity. As will be shown later, large flows like this bring about problems for existing screen types. Hence, it is extremely important to develop new and better screen arrangements.

Existing screens are usually formed by a set of bar screens, which screens are often arranged at a desired location on the wall of the digester in such a way that they form a chessboard-like figure. Such screens are dealt with in the publication WO 9419533, for example. Each "square" comprises a set of vertically arranged bars. Between the bars there is a slot, through which liquid is inducted. The bars are secured in parallel to a cross member, the screen being provided with an angle bar framework.

A problem with this known screen construction is, for example, that it has a relatively great tendency to clog up as the chips stick to the slots. This is to a great extent due to the liquid having velocity in the radial direction, outwards through the screen, this velocity being about five times higher than the velocity of chips heading downwards. Typically, the velocity of the liquid is approximately 10–15 mm/s, whereas the corresponding velocity of the chips is approximately 2–3 mm/s. Part of the chips follow the radial liquid flow of higher velocity and stick to the slots between the screen bars. The problem is made even worse by the fact that it is difficult to get the screen bars exactly parallel. If the bottom end of the slot happens to be to some extent narrower than the top end, chips are more likely to stick to the slot. Further, more chips may accumulate upon the portion of chips stuck to the slot, thus clogging up even a larger part of the screen. The greater the clogged-up screen surface is, the more intensely it will continue to clog up further, since the screen surface still unclogged is exposed to greater loading and hereby also to greater risk of clogging up. Due to the location of the screen and the way in which chips are clogged up, cleaning of the screen is very difficult, being thus an action to be avoided as far as possible.

In other words, prior art screens are difficult to run, and according to many, operation of bar screens is the Achilles heel of the so called Kamyr digesters.

As a solution to the problem, Kvaerner Pulping Technologies AB has in its patent SE-B-501243 suggested a slot screen characterized by horizontal screen bars. We have done experiments on the operation according to this solution and found the following two phenomena to make the solution impractical.

Firstly, the chips lie upon each other in the digester, whereby they easily thrust their way into a horizontal slot. The phenomenon is similar to that of throwing a pack of cards into the air; most of the cards, practically speaking all of them, fall on to the floor, only a few possibly remaining standing. The same applies to chips falling on to the digester; they lie upon each other and may thus thrust into a horizontal slot when moving outwards in the radial direction.

Another, even more critical factor is shives. There are always a great number of shives among the chips. They are approximately the size of a match, sometimes bigger, sometimes smaller. The diameter thereof may be 1–3 mm. Part of these shives are found at the walls and screens of the digester. It is easy to verify that the shives rotate downwards along the wall surface, round their longitudinal axis, the axis being in the horizontal plane. In other words, they act like a needle bearing. If there is a horizontal slot in the screen, these shives rotating downwards will end up in this slot having a width of 1–3 mm. In this way, the horizontal slot screen clogs up.

Therefore, the solution to the problem of clogging up cannot be what is suggested in Kvaerner's patent SE 501243, but there is a better, slightly surprising solution. When arranging the slots of the screen inclined, the angle being 30–60 degrees, preferably 45 degrees relative to the horizontal plane, an arrangement is created which eliminates the traditional screen problems without bringing about new problems as does the solution presented in Kvaerner's patent.

Another reason for arranging the slots inclined is that the chips column rotates slowly, due to the scraper at the bottom of the digester. By positioning the inclined screens in the digester and making the surface thereof profiled, a spiral movement is created which pushes the chips column downwards in the digester. The phenomenon is the same as when a screw rotates in a nut.

Characteristics of the screen according to the invention become apparent in the appended claims.

Figure 2:
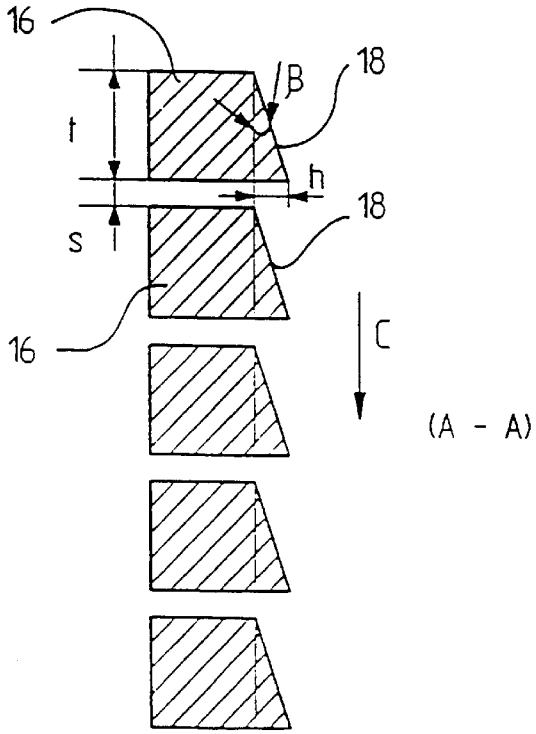
Figure 3:
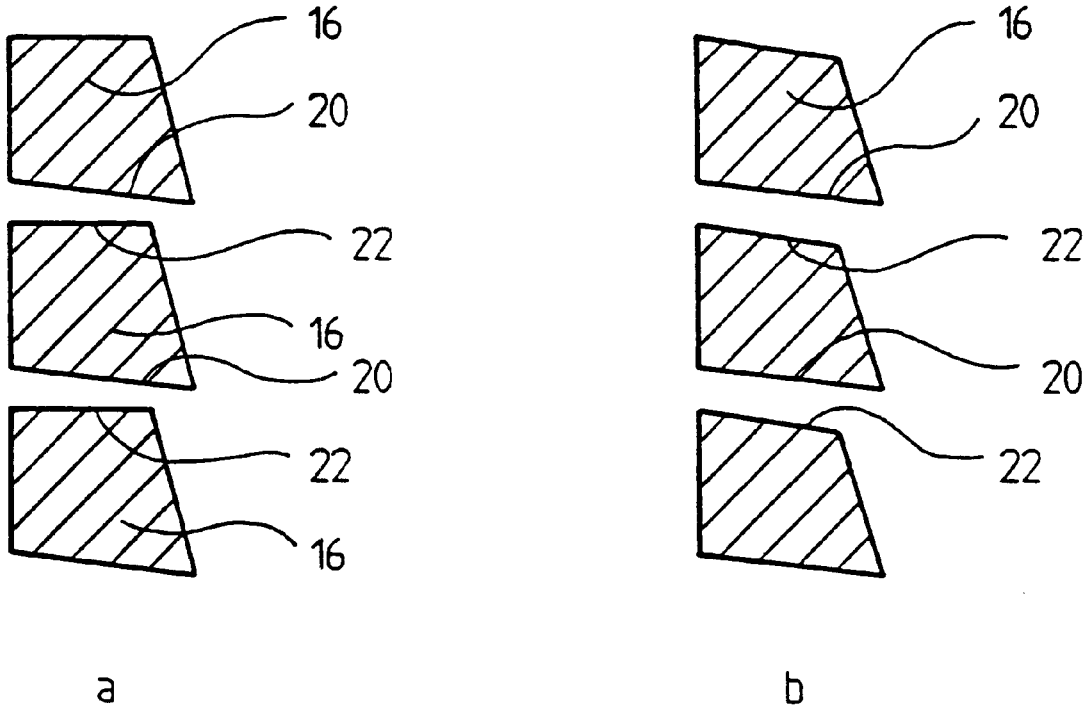

In the following, a screen according to the invention is explained in detail with reference to the appended schematic figures, in which FIG. 1 illustrates one screen plate in a digester;

FIG. 2 illustrates a cross-section along the line A—A of a screen plate showed in FIG. 1 in accordance with a preferred embodiment of the present invention; and FIGS. 3*a* and 3*b* illustrate two cross-sections along the line A—A of a screen plate showed in FIG. 1 in accordance with two preferred embodiments of the present invention.

According to FIG. 1, a screen 10 according to the invention comprises a frame 12 and a screen plate 14 secured to the frame. When needed, the screen plate 14 may be supported of the backside by means of special supporting bars (not shown) secured to the frame 12 or the wall construction of the digester. The height of the screen plate 10 is 1–3 meters and the width 0.5–2 meters. The screen plate 14 may be manufactured by for example milling a so called slot plate from a metal plate or by securing bars 16 (shown in the figures) in parallel in the above-described manner. It has been discovered that the screen plate 14 according to the invention will eliminate the problems induced by prior art plates when the inclination angle α of the slots relative to the horizontal direction is 30–60 degrees. The best result has been achieved when the angle of the slot is 45 degrees. A suitable width s of the slot on a screen plate 14 is 1–5 mm, preferably 2–4 mm. The distance t between the slots is in general 3–9 mm, being usually 1.5–2 times the width of the sloth. A suitable dimensioning is as follows: the width s of the slot is approximately 3 mm, the distance t between the slots being approximately 5 mm. In other words, the width t of the surface between the slots of a milled or otherwise machined screen plate or that of the screen bar 16 is approximately 5 mm.

It is preferable to make the screen plate profiled inside the digester as illustrated in FIG. 2. The depth h of the profile is 1–4 mm, usually 1–2 mm. The width t of the screen bar 16 or that of the surface varying between 3–9 mm, the inclination angle of the leading surface 18 is tan β=h/t, whereby the preferable variation range is 6–24 degrees, more preferably 12–22 degrees.

In addition, the direction of the slots is preferably in accordance with FIG. 1 in such a way that the arrow C in FIG. 1 (and also in FIG. 2) indicates the primary flowing direction in the digester, the arrow D indicating the direction of movement of the scraper in the digester relative to the screen. In other words, as the scraper causes the pulp/chips column to rotate in the direction of the arrow D, the slots, or rather the profiling in connection with them, causes the pulp to be pressed towards the bottom of the digester.

Sometimes, as illustrated in FIGS. 3*a* and 3*b*, it is advantageous to arrange the side surfaces 20 and 22 of the screen bars 16 or of the slots, correspondingly, non-parallel (FIG. 3*a*), or at least non-radial (FIG. 3*b*). When the side surfaces 20 and 22 are non-parallel, the width of the slot between the surfaces increases away from the inside of the digester (i.e. from the right to the left) as shown in FIG. 3*a*. The side surfaces are, in accordance with a preferred embodiment of the invention, arranged such that the lower surface 22 is radial or slightly sloping towards the inside of the digester and the upper surface 20 sloping in a more aggressive angle towards the inside of the digester. What is substantial to a preferred embodiment of the invention is that the width of the slot either remains the same or increases outwards. Accordingly, if the side surfaces 20 and 22 are parallel, it is, in accordance with another preferred embodiment, advantageous to arrange the side surfaces to slope slightly towards the inside of the digester. In all embodiments described above, the angle of slope will range from 0 to 30 degrees, preferably from 0 to 20 degrees.

In accordance with another preferred embodiment of the invention, it is advantageous that the slot is inclined downwards 5–30° as shown in FIG. 3*b*. This makes it possible for the chips that get stuck in the slot to get pulled out by the downflowing pulp. A typical slot length is from 10 cm up to some meters, depending on mounting arrangements.

As disclosed above, a new arrangement has been developed, eliminating the disadvantages of the prior art screen arrangements of continuous digesters. It is also to be

What is claimed is:

1. A digester screen assembly for use in a continuous digester producing cellulose or paper pulp, said screen assembly comprising:

a frame mountable in said continuous digester;

a screen plate mounted in said frame, and said screen plate having a plurality of slots formed therein, each of said slots having a straight line axis and said axis having a uniform angle of inclination α relative to a horizontal plane of between 30–60°.

2. A screen assembly as recited in claim 1 wherein said screen plate includes a leading surface between said slots, and wherein said leading surface has an angle of inclination β between 12–22° to a plane containing said side edges of said screen plate.

3. A screen assembly as recited in claim 1 wherein said slots of said screen plate have a width of between 1–5 millimeters.

4. A screen assembly as recited in claim 3 wherein said slots are spaced from each other a distance between 1.5–2 times the width of said slots.

5. A screen assembly as recited in claim 1 wherein said slots are spaced from each other a distance between 1.5–2 times the width of said slots.

6. A screen assembly as recited in claim 1 wherein said screen plate comprises a plurality of parallel screening bars secured side-by-side.

7. A screen assembly as recited in claim 1 wherein said screen plate comprises an integral metal plate with said slots machined therein.

8. A screen assembly as recited in claim 1 wherein said screen plate includes a leading surface between said slots, and wherein said leading surface has an angle of inclination β between 6–24° to a plane containing said side edges of said screen plate.

9. A screen assembly as recited in claim 8 wherein said slots of said screen plate have a width of between 2–4 millimeters.

10. A screen assembly as recited in claim 8 wherein said slots are spaced from each other a distance between 1.5–2 times the width of said slots.

11. A screen assembly as recited in claim 8 wherein said screen plate comprises a plurality of parallel screening bars secured side-by-side.

12. A screen assembly as recited in claim 8 wherein said screen plate comprises an integral metal plate with said slots machined therein.

13. A screen assembly as recited in claim 1 wherein the screen plate has substantially parallel top and bottom edges, and substantially parallel first and second side edges substantially perpendicular to said top and bottom edges.

14. A screen assembly as recited in claim 1 wherein said slots have a spacing therebetween of between 3–9 millimeters.

15. A screen assembly as recited in claim 14 wherein said slots have a width narrower than said spacing between the slots.

* * * * *